US005084923A

United States Patent [19]

Guillot

[11] Patent Number: 5,084,923

[45] Date of Patent: Feb. 4, 1992

[54] CRIB WITH STABILIZER BAR AND HIDDEN CONNECTOR FOR STABILIZER BAR

[75] Inventor: Edmund P. Guillot, Putnam, Conn.

[73] Assignee: Gem Industries Inc., Gardner, Mass.

[21] Appl. No.: 537,897

[22] Filed: Jun. 13, 1990

[51] Int. Cl.[5] ..... A47D 7/00

[52] U.S. Cl. ..... 5/93.1; 5/207; 5/296

[58] Field of Search ..... 5/93.1, 100, 207, 208, 5/282, 296, 299

[56] References Cited

U.S. PATENT DOCUMENTS

| | | | |
|---|---|---|---|
| 1,291,855 | 1/1919 | Hammett | 5/296 |
| 1,366,743 | 1/1921 | O'Connor | 5/296 |
| 2,242,307 | 5/1941 | Kroll | 5/93.1 |
| 2,414,076 | 1/1947 | Webb | 5/93.1 |
| 4,703,524 | 11/1987 | Brunner | 5/93.1 |
| 4,706,312 | 11/1987 | Shamie | 5/93.1 |
| 4,802,248 | 2/1989 | Moroney | 5/207 |
| 4,825,482 | 5/1989 | Paris | 5/93.1 |
| 4,951,330 | 8/1990 | Burnham | 5/93.1 |

FOREIGN PATENT DOCUMENTS

| | | | |
|---|---|---|---|
| 96132 | of 1923 | Austria | 5/296 |

*Primary Examiner*—Renee S. Luebke
*Assistant Examiner*—F. Saether
*Attorney, Agent, or Firm*—Charles R. Fay

[57] ABSTRACT

A dropside crib that can be set up and taken down without tools, the crib including a lengthwise stabilizer bar for the dropside side thereof, the stabilizer bar having a pair of vertically aligned spaced hooks at each end, the hooks extending toward the person operating the crib, and a pair of hook receiving slots on the corner posts of the crib in position to accept the hooks when the bar is manually correctly aligned, and having entered the hooks in the slots, the operator merely pushes down on the bar to removably secure the parts, the hooks being tapered.

3 Claims, 4 Drawing Sheets

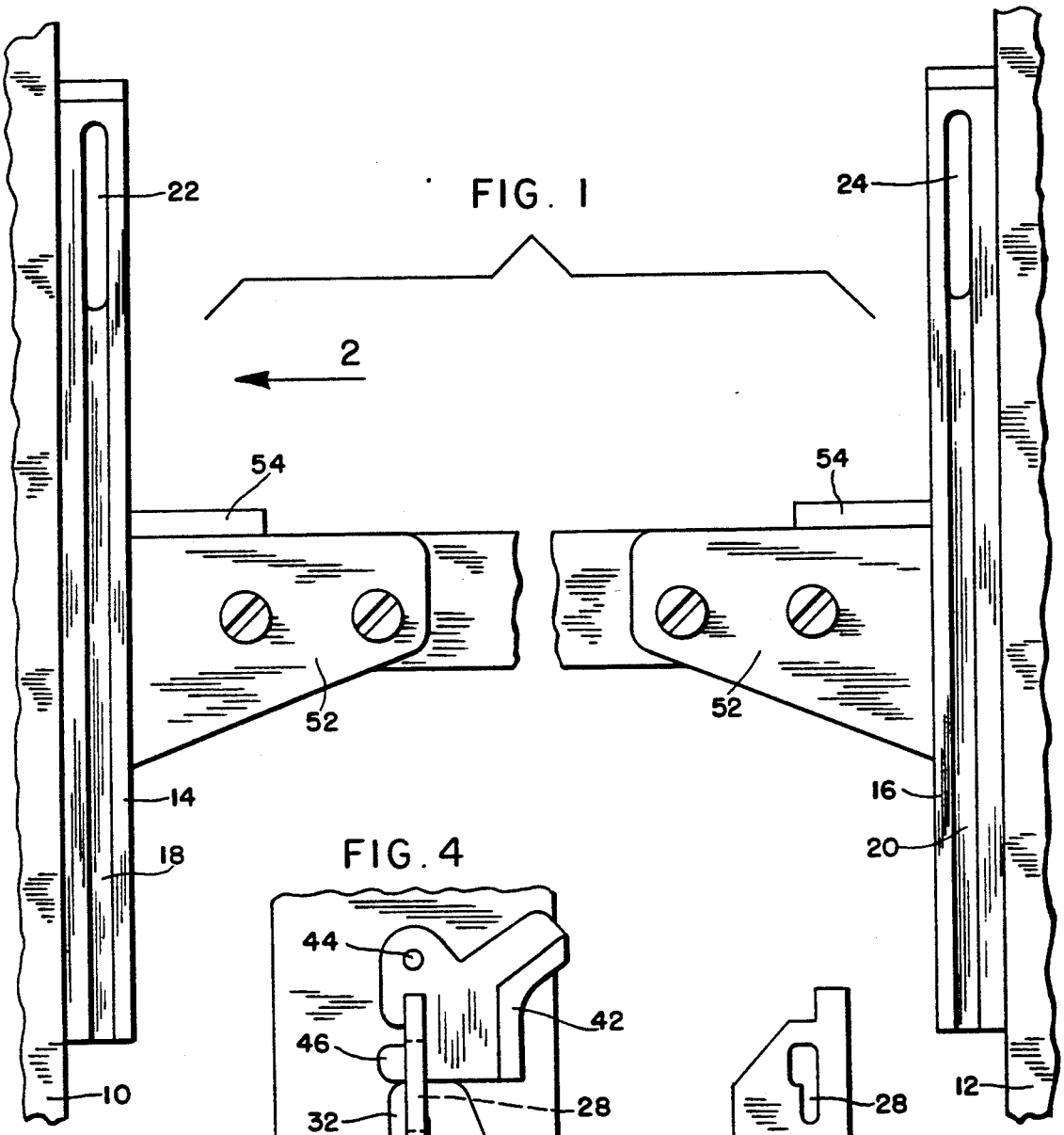
FIG. 1
FIG. 4
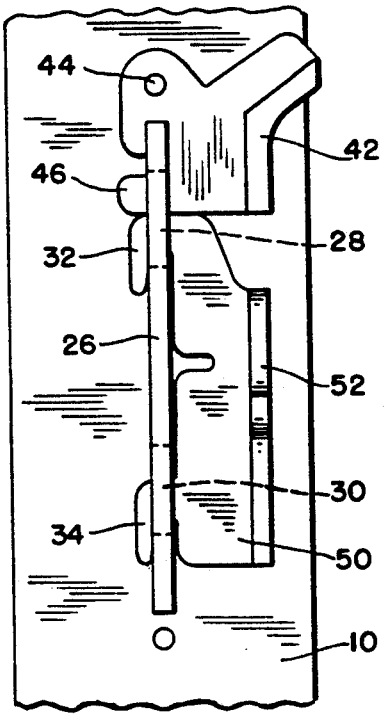
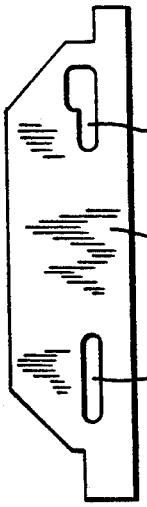
FIG. 5

CRIB WITH STABILIZER BAR AND HIDDEN CONNECTOR FOR STABILIZER BAR

BACKGROUND OF THE INVENTION

Infant's cribs ordinarily include end panels connected to side structures forming a rectangular crib. One side, the rear of the crib, is usually fixed to the respective edge portions of the end panels, but the front side usually comprises a "dropside", i.e., a side that has an up locked position for keeping the child in the crib, and a down position in which the attendant can care for the child, place it in the crib and take it out, etc. The usual dropside is not fixed to the end panels, making the use of a fixed stabilizing bar between the panels a necessity in holding the crib fixed in relation to the end panels and the crib sides. The stabilizing bar is fixed in position by bolts or screws, requiring the use of a tool for assembly. This invention provides a structure quickly and easily assembled by the owner without tools.

Most end panels have edge secured corner posts for strength, but in some cases, corner posts can be avoided if the panels are tall and strong enough, the dropside and stabilizing bar then being fixed to the edge portions of the panels. Where corner posts are used, the dropside and bar are attached to the corner posts.

SUMMARY OF THE DISCLOSURE

All of the present cribs may be as desired except the stabilizing bar, and only so much of the crib is disclosed here as is necessary to fully explain the invention. The stabilizing bar is provided at its ends with brackets each of which has an edge bent at right angle to the general plane of the bar and the brackets, i.e., forwardly, so that the resultant flanges face the attendant. Each flange has a pair of spaced hooks with tapering points so that when the bar is correctly placed and brought toward the attendant the hooks enter slots therefor in a special slotted piece to be described, pulled down, and become solidly secured with respect to the special piece, because of the taper of the hooks. No tools are necessary for this assembly, or disassembly.

The special slotted piece is a keel plate that is located in a guide strip for the dropside, the guide strip being secured to the inside aspect of the respective corner posts or panel facing the interior of the crib. The corner post or panel is slotted to receive a portion of the keel plate that extends from the rear face of the guide into the slot. The dropside guide is recessed to receive the hooked flange of the bracket between the dropside guide and the corner post. The keel plate is at a right angle to the flange and the slots are in the dropside recess, so the flange is entered between dropside guide and the corner post (or panel), with the tapered hooks entering the slots. When the hooks are thus entered, the attendant simply pushes down on the stabilizing bar, thereby firmly engaging hooks and edges of the slots, and the two motion actions to remove the bar is of course the opposite.

BRIEF DESCRIPTION OF THE DRAWINGS

FIG. 1 is an elevational view of the stabilizing bar and the corner which it is fixed, parts being broken away;

FIG. 4 is a detail of the keel plate and bracket with the dropside guide removed;

FIG. 5 is a detail of the keel plate;

PREFERRED EMBODIMENT OF THE INVENTION

Figure 2:
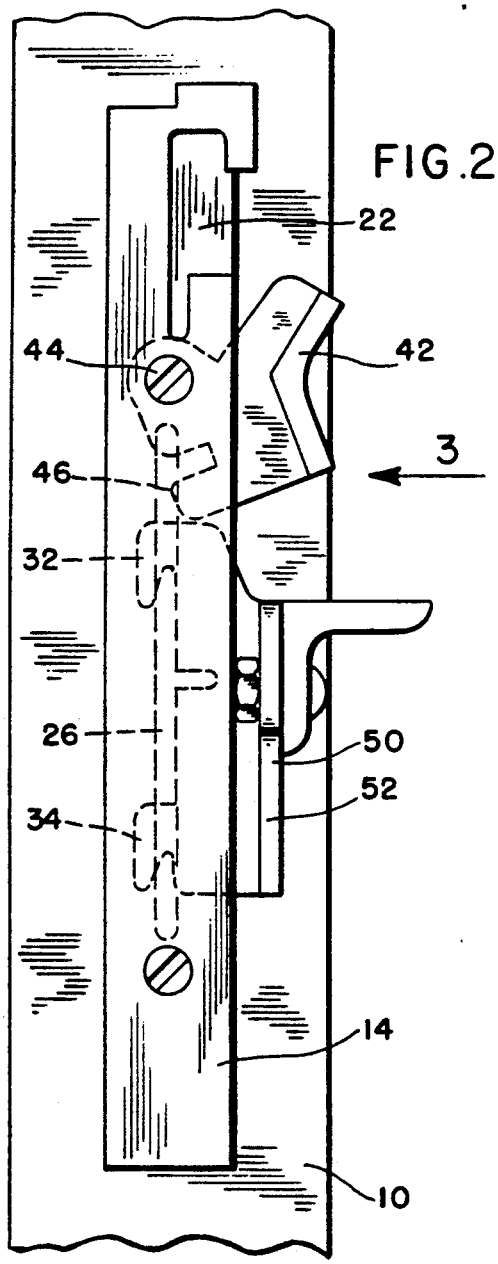
FIG. 2 is an elevational view looking in the direction of arrow 2 in FIG. 1.
Figure 3:
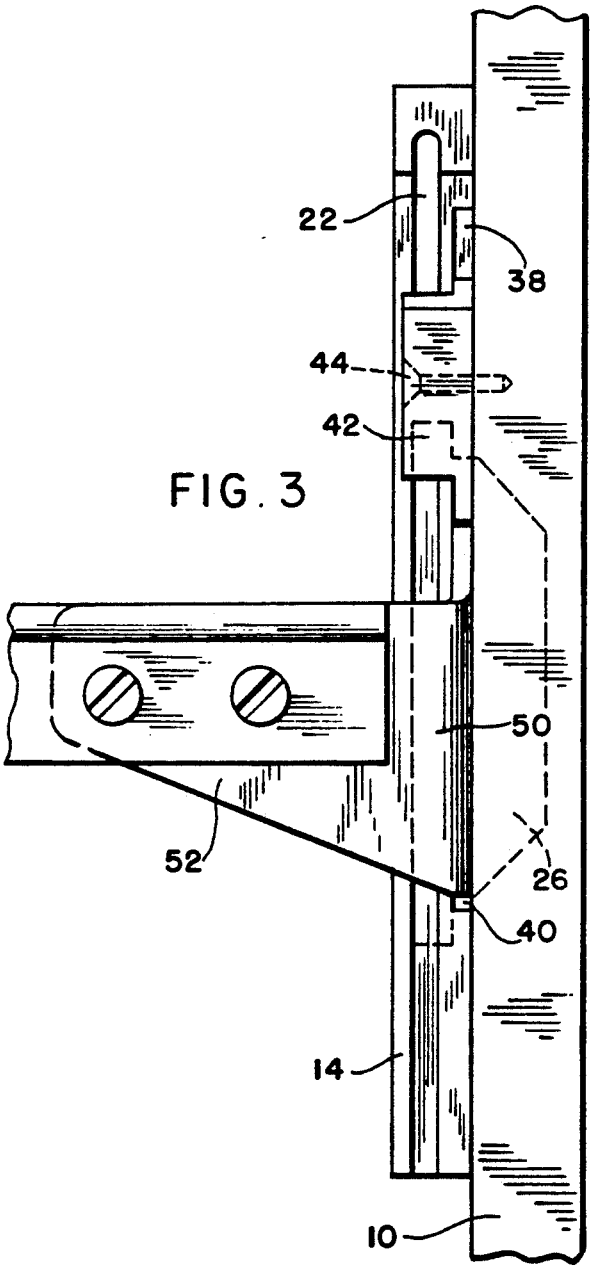
FIG 3 is an elevational view looking in the direction of arrow 3 in FIG. 2.
Figure 7:
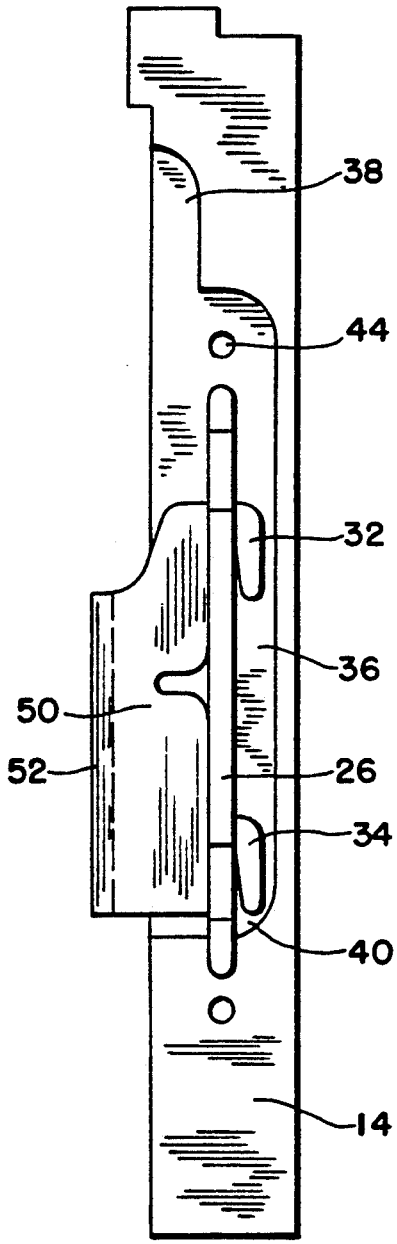
FIG. 7 is a detail of the rear of the guide and showing its recess, plate, and flange.
Figure 6:
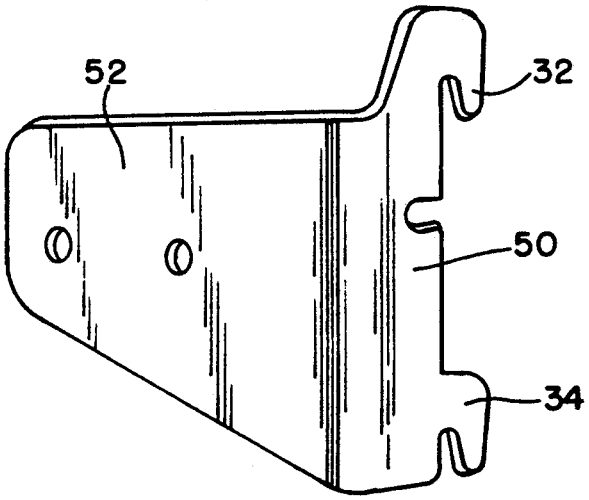
FIG. 6 is a perspective view of the bracket and its hooks.

Only so much of the crib and dropside are shown as is sufficient to explain the invention. The focus of the invention is shown in FIG. 1, wherein 10 and 12 indicated corner posts at the dropside of the crib, and 14 and 16 indicate the respective dropside guides which are part of the present invention as well as guiding, supporting, and latching the respective dropside not shown, but moving vertically guided in grooves 18 and 20 and latched by means not shown as by openings 22, 24 in the guides.

The corner posts may have casters not shown or they can sit on the floor. The guides and corner posts are secured in flat-wise, facing condition, the dropside guides facing each other from end to end of the crib. A flat keel plate 26 is fastened in either a corner post or a dropside guide in lengthwise position at a right angle thereto, and this keel plate extends into a slot in the other one of the guide and post construction. The keel plate is well fastened as by cement, friction or fastener but is preferred to be set by friction into its place in guide and corner post, where it is concealed from view. Slots 28 and 30 are so placed that they will receive the stabilizing bar bracket hooks to be described, to secure the bar to the crib corner posts, and rigidify the dropside side of the crib. When the parts are assembled, the slots 28, 30, are accessible to the hooks 32, 34, see FIG. 4, just between the dropside guide and the respective corner post. To this end, the dropside guides 14 and 16 are recessed as at 36, 38, and 40 to a depth just enough to receive the hooks 32 and 34 on flange into slots 28, 30. The depth of this recess is about the narrow width of the slots.

A pivoted latch 42 is mounted as by a fastener 44 that also holds the respective guide to its corner post. This latch has a nose 46 that can also be situated at the top end of slot 28 in keel plate 26, to press on the back of hook 32, see FIGS. 4 and 5, to hold the hooks in place in their slots. The hooks 32, 34 are on the end edge of flanges 50 on corresponding brackets 52, to which the stabilizer bar 54 is secured, e.g. by rivets.

The identifying numerals in this case are used interchangeably at the ends of the stabilizing bar because they indicate the same elements at each end of the crib, but are mirror images of each other.

Figure 8:
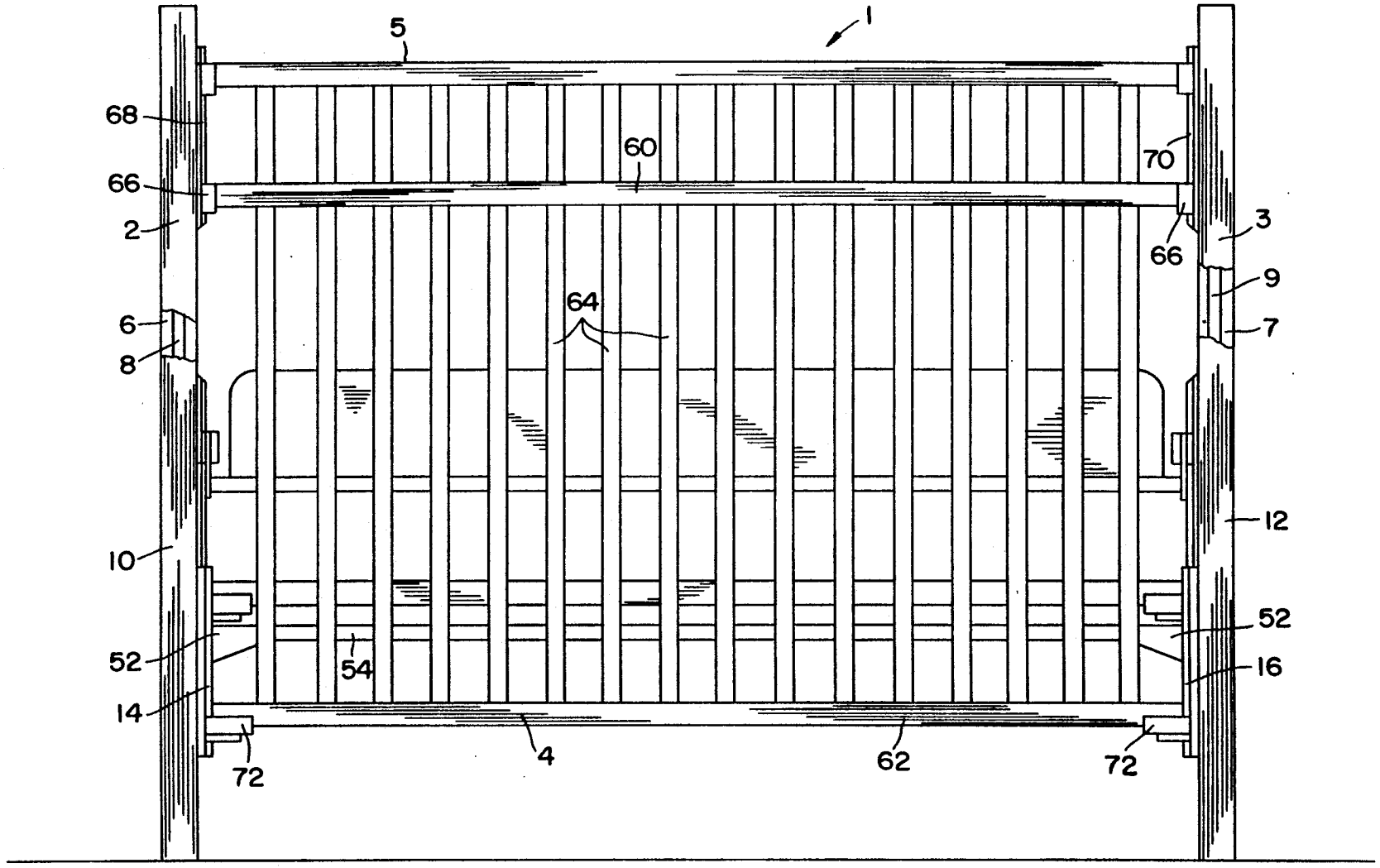
FIG. 8 is a front elevational view of a crib including the stabilizer bar and hidden connector of the present invention.

FIG. 8 shows a crib of the general type illustrated in FIG. 1 of U.S. Pat. No. 4,951,330, Benjamin K Burnham, Aug. 28, 1990, which is included herein in order to show a crib which has been modified by the present invention.

The crib 1, conventionally includes opposite end panels 2 and 3 and opposite sides 4 and 5, at least one of which is a dropside. The side 4 will be referred to as a front dropside and the side 5 will be referred to as a rear side which may be a dropside similar to the front dropside 4 or it may be fixed.

The end panel 2 has edge located corner posts 6 and 10 with an intermediate panel section 8. The end panel 3 has edge located corner posts 7 and 12 with an intermediate panel section 9.

The front dropside 4 has top and bottom rails 60 and 62 connected by vertical styles 64. The top rail 60 has end brackets 66 that slide on top guides 68 and 70. The bottom rail 62 has end brackets 72 that slide on bottom guides 14 and 16.

The stabilizer bar 54 and its end brackets 52, which together with the guides 18 and 20 and corner posts 10 and 12 form the focus of the invention, are shown positioned above the bottom rail 62 in FIG. 8.

Other crib parts shown in FIG. 8 which are not identified herein and which form no part of this invention, are identified in FIG. 1 of U.S. Pat. No. 4,951,330.

The operator or assembler stands at the front of the crib, after assembling the entire apparatus except for the stabilizing bar, leans over forwardly to position the bar with flanges 50 facing forward or toward him to fit the recesses 36, pulls the parts toward himself to set the hooks 32, 34 at the slots 28, 30, in the keel plate, then merely pushes downwardly on the stabilizing bar to set the hooks, wedged in place. No tools are needed, and the set up is easy to make, and strong, resisting any possible upward motion, especially after pivoting latch 42 down to engage hook 32 as in FIG. 4.

I claim:

1. A child's crib including end panels and interconnected sides, one side being a dropside, and a stabilizer bar having its ends connected to the panels at the side of the crib having the dropside, a corner post at each edge of each panel, and means detachably connecting the stabilizer bar to a respective corner post at the dropside side of the crib, said connecting means comprising a flat plate secured to a portion of the bar, a flange on the flat plate, and a pair of spaced downwardly extending tapering hooks on the flange at its edge portion remote from the flat plate, a guide member on each respective corner post, said guide being parallel to the corner post and at a right angle to the flat plate, a keel plate parallel to the guide and fixed between the guide and the corner post, having a portion in a respective slot in the corner post and guide, a pair of generally parallel slots in the keel plate, said slots being adapted to receive the hooks simultaneously, an enlargement in one slot, a depression in the guide in the area of the keel plate, said depression facing the respective corner post, the slots being accessible to the hooks because of the depression, the guide and corner post being flatwise positioned completely hiding the keel plate except for the area of the slots, the slots being enterable by the hooks and the bracket and hooks being locked in relation to the keel plate upon a downward thrust thereon once the hooks have entered the slots, and a latch having two positions, a tongue on the latch to enter the enlargement in one position to lock the stabilizer bar in position, said latch being free of the keel plate in the other position of the latch, the stabilizer bar being capable of removal from the respective corner post only in the free position of the latch relative to the respective slot.

2. The child's crib of claim 1 wherein the latch is pivoted on and between the guide and corner post, and a finger element on the latch to move it between its two positions.

3. The child's crib of claim 2 wherein the keel plate slot enlargement and the tongue on the latch are adapted to hold position while locked, but the latch is still free to be manually moved to free position.

* * * * *